United States Patent [19]

Embree

[11] 4,125,210

[45] Nov. 14, 1978

[54] ATTACHMENT FOR PAINT CANS

[75] Inventor: Milo J. Embree, Omaha, Nebr.

[73] Assignee: Lawrence Peska Associates, Inc., New York, N.Y.

[21] Appl. No.: 819,110

[22] Filed: Jul. 26, 1977

[51] Int. Cl.[2] ..... B65D 25/40; B65D 41/18; B65D 51/18

[52] U.S. Cl. ..... 222/570; 220/90; 220/254; 220/306; 220/307; 220/352; 248/110

[58] Field of Search ..... 15/257.5, 257.05; 222/567, 570; 248/110, 111, 113; 220/90, 352, 356, 307, 254, 306; 401/121, 122, 123, 124, 129; 206/15.2, 15.3, 361, 362.2, 362.3

[56] References Cited

U.S. PATENT DOCUMENTS

| | | | |
|---|---|---|---|
| D. 207,051 | 2/1967 | Bainbridge | D9/289 |
| 2,418,502 | 4/1947 | Ferguson | 220/90 |
| 2,564,979 | 8/1951 | Jorgensen | D9/289 |
| 2,960,257 | 11/1960 | Sasse | 222/570 |
| 3,221,955 | 12/1965 | Banaszak et al. | 222/570 |
| 3,239,113 | 3/1960 | Knize | 220/90 |
| 3,329,307 | 7/1967 | Jacobson | 220/90 |
| 3,356,266 | 12/1967 | Pinter, Jr. | D9/290 |
| 3,400,867 | 9/1968 | Giannone | 222/570 |
| 3,899,107 | 8/1975 | Gaal | 220/570 |
| 3,980,213 | 9/1976 | Ramsay | 220/90 |
| 4,014,465 | 3/1977 | Ritter | 220/90 |

FOREIGN PATENT DOCUMENTS

| | | | |
|---|---|---|---|
| 1,051,033 | 12/1966 | United Kingdom | 220/307 |

*Primary Examiner*—William Price
*Assistant Examiner*—Allan N. Shoap

[57] ABSTRACT

An attachment for paint cans, the attachment comprising an annular collar adapted for snap-fit engagement with the rim of a paint can, the collar having an annular floor portion and a wall portion upstanding therefrom, a brush rest portion extending from the collar in a first direction and a spout portion extending from the collar in a second direction, and a cover member engageable with interior portions of the collar and operable to close the opening therein.

3 Claims, 2 Drawing Figures

ATTACHMENT FOR PAINT CANS

BACKGROUND OF THE INVENTION

1. Field of the Invention

This invention relates to attachments for grooved rimmed containers such as paint, varnish, and shellac cans, and is directed more particularly to an annular attachment adapted to be mounted on the rim of such a container.

2. Description of the Prior Art

Several paint can attachments have been developed in an effort to overcome the messiness attendant upon the use of cans of paint, varnish, or the like. U.S. Pat. Nos. 2,564,979, issued Aug. 21, 1951 to D. F. Jorgensen; 2,674,391, issued Apr. 6, 1954, in the name of R. B. Davis; 3,400,867, issued Sept. 10, 1968, in the name of D. S. Giannone; 3,811,606, issued May 21, 1974, in the name of Jerome C. Higgins; and 3,894,651, issued July 15, 1975, in the name of Louis A. Crump all disclose attachments for connection to paint cans, the object being to reduce spillage of paint or other matter contained. In the devices so disclosed, it is necessary in order to close the can, that the attachment device be removed and the original top be replaced. The patents to Davis and Jorgensen show means for holding a paint brush while not in use, but upon closure of the can the paint brush holding means is removed from the can, thereby leaving the operator to find another location for disposal of his paint brush during a short interlude.

SUMMARY OF THE INVENTION

An object of the present invention is to provide an attachment for paint cans and the like, the attachment having a top portion to permit closure of the can without removal of the attachment during short interludes, and the attachment being provided with means for receiving a paint brush when the brush is not in use.

A further object of the invention is to provide such a device as may be easily and securely snapped onto the rim of a paint can, and easily removed therefrom.

A still further object of the invention is to provide such a device as is economical to manufacture and easy to use. A still further object of the device is to provide means for controlling drippage at the open end of a paint can, means for closing the can when not in use, means for receiving a paint brush when the brush is not in use, and spout means facilitating pouring of paint from the container into a second container.

With the above and other objects in view, as will hereinafter appear, a feature of the present invention is the provision of an attachment for paint cans, the attachment comprising an annular collar adapted for snap-fit engagement with the rim of a paint can, the collar having an annular floor portion and a wall portion upstanding therefrom, a brush rest portion extending from the collar in a first direction, a spout portion extending from the collar in a second direction generally opposite from the first direction, and a cover member engageable with interior portions of the collar and operable to close the opening therein.

The above and other features of the invention, including various novel details of construction and combinations of parts, will now be more particularly described with reference to the accompanying drawings and pointed out in the claims. It will be understoood that the particular device embodying the invention is shown by way of illustration only and not as a limitation of the invention. The principles and features of this invention may be employed in various and numerous embodiments without departing from the scope of the invention.

DESCRIPTION OF THE DRAWINGS

Reference is made to the accompanying drawings in which is shown an illustrative embodiment of the invention from which its novel features and advantages will be apparent.

DESCRIPTION OF THE PREFERRED EMBODIMENT

Figure 1:
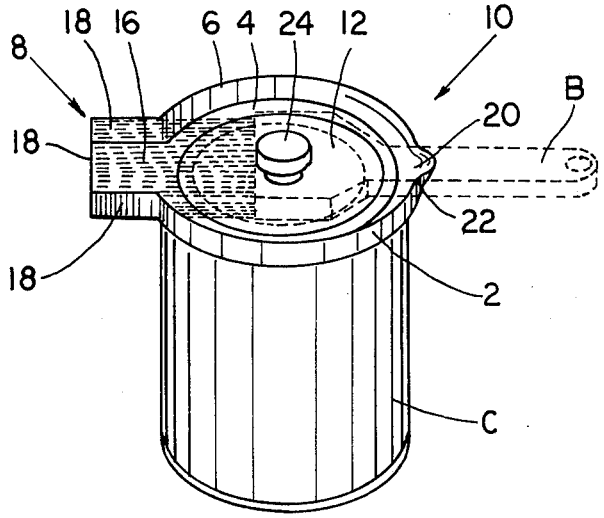
FIG. 1 is a perspective view of one form of attachment illustrative of an embodiment of the invention.

Referring to the drawings, it will be seen that the illustrative device includes an annular collar 2 adapted for snap-fit engagement with the rim R of a paint can C. The collar 2 is provided with an annular floor portion 4 and a wall portion 6 upstanding therefrom. A brush rest portion 8 extends outwardly from the collar 2 in a first direction and a spout portion 10 extends outwardly from the collar 2 in a second direction. A cover member 12 is engageable with interior portions of the collar 2 and operable to close an opening 14 therein.

The brush rest portion 8 comprises an outward extension 16 of the floor portion 4 and an outward extension 18 of the wall portion 6. As may be seen in FIG. 1, the brush rest portion 8 is shaped so as to readily receive a bristle portion of a paint brush B.

The spout portion 10 comprises an outward extension 20 of the floor portion 4 and an outward extension 22 of the wall portion 6. In the area of the spout portion 10 the wall extension 22 extends outwardly to facilitate pouring of liquid from the can C.

The cover member 12 comprises a circular plate-like member having a handle 24 centrally thereof. The handle 24 is flat on its top and is in alignment with the brush rest portion 8 and the spout portion 10, the brush rest portion, spout portion, and handle, cooperating to provide a receiving area for the paint brush B, as seen in FIG. 1. As can also be seen in FIG. 1, the uppermost surface of handle 24 and of the wall portions 6, 18, and 22 are in the same horizontal plane.

Figure 2:
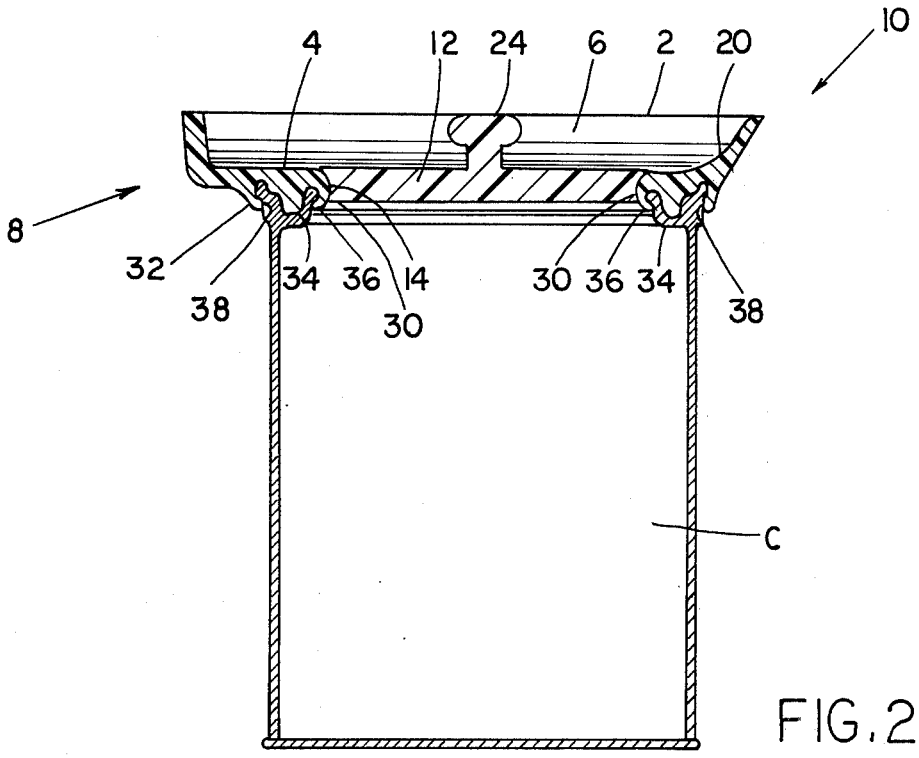
FIG. 2 is a center line sectional view of the attachment device.

Referring to FIG. 2, it will be seen that the collar 2 is provided with means facilitating the snap-fit engagement of the collar with the paint can, the engagement means comprising a first engagement portion 30 depending from the collar and adapted to engage the inside edge of the paint can rim, and a second engagement portion 32 depending from the collar and adapted to engage the outside edge of the rim of the paint can. The collar is further provided with a third engagement portion 34 which depends from the collar, is disposed between the first and second engagement portions and is adapted to engage an annular groove disposed substantially centrally of the rim. The first engagement portion is provided on its free end with an outwardly directed flange 36 adapted to underlie the inside edge of the rim of the can, and the second engagement portion 32 is provided on its free end with an inwardly directed flange 38 adapted to underlie the outside edge of the rim of the paint can.

Preferably, the annular collar 2 is of molded plastic and the first and second engagement portions 30, 32 are adapted to override the rim edges by plastic deformation but to snap back to their original shape to permit the flange portions 36, 38 to underlie the rim edges, whereby to securely but removably fasten the collar to the paint can rim.

The attachment is rotatably movable on the can rim and can be moved to a position 90° from the position shown in FIG. 1 to permit a handle H of the paint can C to be utilized in normal fashion.

In use, the ordinary paint can top is removed and the annular collar 2 snapped onto the rim of the open can. A brush may then be used for painting operations, the brush being wiped along the inside edges of the opening 14 to remove excess paint, and further dragged along the edge of the collar 2 to prevent subsequent drippage from the paint brush. When it is desired to put down the paint brush for a brief period, the brush may be placed on the brush rest portion, with the handle resting upon the spout portion. If it is desired to interrupt painting for a longer period of time, the cover member 12 may be used to close the opening 14, and the brush may be placed as shown in FIG. 1, supported by the brush rest portion 8, the spout portion 10, and the cover handle 24. Upon use of the contents of the can, the collar may be removed, the engagement portions of the collar giving way under plastic deformation to permit removal of the collar from the can. Inasmuch as the rim groove of the can has been occupied by the third engagement portion 34, there is no need to consider paint left in the groove and inclined to spill therefrom. If it is desired to transfer paint from the can to a second container, the spout portion 10 of the collar may be utilized to effect pouring cleanly from one container into another.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patent of the United States is:

1. An attachment for paint cans, said attachment comprising an annular collar having attaching means on one side thereof for snap-fit engagement with the rim of a paint can, said collar on the side opposite said one side having an annular substantially flat surface and a wall portion upstanding therefrom, a brush rest portion extending laterally outwardly from said collar in a first direction and comprising an outward extension of said flat surface and said wall portion and shaped to receive a bristle portion of a paint brush, a spout portion extending from said collar in a second direction generally opposite from said first direction comprising an outward extension of said flat surface and said wall portion, said wall portion upstanding from said spout portion being inclined outwardly, and a cover member having an inwardly rounded edge engageable with an outwardly rounded interior portion of said collar and operable to close the opening therein by snap-fit engagement, said cover member being provided with handle means centrally thereof; the uppermost surface of said handle means and said wall portion of said brush rest portion and of said spout portion being in the same horizontal plane; and said brush rest portion, said handle means, and said spout portion being aligned to cooperatively receive a paint brush.

2. The invention according to claim 1 in which said attaching means comprises a first engagement portion depending from said collar and adapted to engage the inside edge of said rim of said paint can, a second engagement protion depending from said collar and adapted to engage the outside edge of said rim of said paint can, and a third engagement portion depending from said collar and adapted to engage an annular groove disposed substantially centrally of said rim.

3. The invention according to claim 2 in which said first engagement portion is provided on its free end with an outwardly directed flange adapted to underlie said inside edge of said rim of said paint can, and said second engagement portion is provided on its free end with an inwardly directed flange adapted to underlie said outside edge of said rim of said paint can.

* * * * *